US011142944B2

(12) United States Patent
Jackson et al.

(10) Patent No.: US 11,142,944 B2
(45) Date of Patent: Oct. 12, 2021

(54) SLAT ANGLE ADJUSTMENT MECHANISM FOR WINDOW BLINDS

(71) Applicant: Home Depot Product Authority, LLC, Atlanta, GA (US)

(72) Inventors: Nicholas Jackson, Marietta, GA (US); Nicholas Servies, Kennesaw, GA (US)

(73) Assignee: Home Depot Product Authority, LLC, Atlanta, GA (US)

( * ) Notice: Subject to any disclaimer, the term of this patent is extended or adjusted under 35 U.S.C. 154(b) by 165 days.

(21) Appl. No.: 15/857,294

(22) Filed: Dec. 28, 2017

(65) Prior Publication Data

US 2019/0203530 A1 Jul. 4, 2019

(51) Int. Cl.

| | |
|---|---|
| ***E06B 9/306*** | (2006.01) |
| ***E06B 9/322*** | (2006.01) |
| ***E06B 9/307*** | (2006.01) |
| ***E06B 9/78*** | (2006.01) |
| *E06B 9/28* | (2006.01) |

(52) U.S. Cl.

CPC ..... *E06B 9/322* (2013.01); *E06B 9/306* (2013.01); *E06B 9/307* (2013.01); *E06B 9/78* (2013.01); *E06B 2009/285* (2013.01)

(58) Field of Classification Search

CPC ..... E06B 9/304; E06B 9/303; E06B 9/307; E06B 9/32; E06B 9/322; E06B 2009/285; E06B 9/30; E06B 9/306; E06B 9/305; E06B 9/308; E06B 2009/3225; E06B 9/26; E06B 9/266

See application file for complete search history.

(56) References Cited

U.S. PATENT DOCUMENTS

| | | | | |
|---|---|---|---|---|
| 4,621,672 | A * | 11/1986 | Hsu | E06B 9/307 160/115 |
| 4,719,955 | A * | 1/1988 | Tachikawa | E06B 9/307 160/168.1 R |
| 5,052,150 | A | 10/1991 | Chen | |
| 5,092,387 | A | 3/1992 | King et al. | |

(Continued)

FOREIGN PATENT DOCUMENTS

| | | |
|---|---|---|
| DE | 3518371 | 5/1991 |
| WO | 2011071331 | 6/2011 |

OTHER PUBLICATIONS

Self-locking worm gears: fact or fiction?, Dr. Albert V. Karvelis, Mar. 1, 2000, accessed Jun. 12, 2020 from https://www.machinedesign.com/motors-drives/article/21834661/selflocking-worm-gears-fact-or-fiction (Year: 2000).*

*Primary Examiner* — Catherine A Kelly
*Assistant Examiner* — Jeremy C Ramsey
(74) *Attorney, Agent, or Firm* — Greenberg Traurig, LLP

(57) ABSTRACT

An apparatus for adjusting a tilt angle of a plurality of slats in a window blind. The window blind includes a headrail having disposed therein a shaft that rotates responsive to rotation of an externally accessible angle adjustment wand. The apparatus includes a pulley coupled with the shaft and the slats. The pulley causes adjustment of the tilt angle of the slats in response to rotation of the shaft, provides a first torque at a first position corresponding to an open position of the slats and a second torque at a second position corresponding to an approximately closed position of the slats, where the second torque is greater than the first torque.

12 Claims, 5 Drawing Sheets

(56) References Cited

U.S. PATENT DOCUMENTS

| | | | | |
|---|---|---|---|---|
| 5,238,043 | A * | 8/1993 | Woodring | E06B 9/307 160/175 |
| 5,341,865 | A * | 8/1994 | Fraser | E06B 9/307 160/176.1 R |
| 5,472,035 | A | 12/1995 | Biba et al. | |
| 6,283,192 | B1 | 9/2001 | Toti | |
| 6,736,185 | B2 | 5/2004 | Smith et al. | |
| 6,845,802 | B1 * | 1/2005 | Anderson | E06B 9/307 160/115 |
| 6,973,952 | B2 | 12/2005 | Nien | |
| 7,194,840 | B2 | 3/2007 | Zimmermann | |
| 7,717,153 | B2 | 5/2010 | Gramsch | |
| 7,802,608 | B2 | 9/2010 | Anderson et al. | |
| 8,251,119 | B2 | 8/2012 | Toti | |
| 9,574,396 | B2 | 2/2017 | Toti | |
| 2010/0263808 | A1 | 10/2010 | Hanley et al. | |
| 2010/0269987 | A1 * | 10/2010 | Martin | E06B 9/262 160/309 |
| 2011/0100564 | A1 | 5/2011 | McTaggert | |
| 2011/0253321 | A1 * | 10/2011 | Yu | E06B 9/303 160/170 |
| 2017/0081912 | A1 | 3/2017 | Guillory | |
| 2019/0003252 | A1 * | 1/2019 | Huang | E06B 9/307 |

* cited by examiner

180 Degrees

90 Degrees

Zero Degrees

SLAT ANGLE ADJUSTMENT MECHANISM FOR WINDOW BLINDS

BACKGROUND

Slat angle adjustment mechanisms in conventional horizontal window blinds typically utilize a wand connected to a worm gear. Conventionally, the worm gear was necessary because the last amount of slat rotation to completely close the slats requires considerable torque, and the weight of the slats causes a "back-drive," which rotates the slats down so that they are not completely closed. Worm gears provide the necessary torque to completely close the slats and also have relatively high friction, which resists the back-drive. However, because worm gears have a relatively large gear ratio, they also require many turns to close the slats and therefore are slow and inconvenient.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

An embodiment of the present invention is directed to an apparatus for adjusting a tilt angle of a plurality of slats in a window blind, which includes a headrail having disposed therein a shaft that causes the tilt angle of the slats to be adjusted when the shaft is rotated. The apparatus includes a rod having a first end and a second end, where the first end adapted to couple with a wand. The apparatus also includes a first bevel gear coupled with the rod and a second bevel gear in mechanical communication with the first bevel gear and coupled with the shaft. A rotation of the wand causes a corresponding rotation of the shaft to adjust the tilt angle of the slats.

An apparatus for adjusting a tilt angle of a plurality of slats in a window blind. The window blind includes a headrail having disposed therein a shaft that rotates responsive to rotation of an externally accessible angle adjustment wand. The apparatus includes a pulley coupled with the shaft and the slats. The pulley causes adjustment of the tilt angle of the slats in response to rotation of the shaft, provides a first torque at a first position corresponding to an open position of the slats and a second torque at a second position corresponding to an approximately closed position of the slats, where the second torque is greater than the first torque.

Another embodiment of the present invention is directed to apparatus for adjusting a tilt angle of a plurality of slats in a window blind, which includes a headrail having a shaft disposed therein. The apparatus includes a gear assembly adapted to couple with a wand and the shaft. The gear assembly includes one or more bevel gears in which a rotation of the wand causes a corresponding rotation of the shaft. The gear assembly also includes a pulley coupled with the shaft and the slats, in which the pulley causes adjustment of the tilt angle of the slats in response to rotation of the shaft, provides a first torque at a first position corresponding to an open position of the slats, and provides a second torque at a second position corresponding to an approximately closed position of the slats, where the second torque is greater than the first torque.

An apparatus for adjusting a tilt angle of a plurality of slats in a window blind, which includes a headrail having a shaft disposed therein. The apparatus includes a gear assembly, which includes a rod having a first end and a second end, in which the first end adapted to couple with a wand. The gear assembly also includes a first bevel gear coupled with the rod and a second bevel gear in mechanical communication with the first bevel gear and coupled with the shaft. A rotation of the wand causes a corresponding rotation of the shaft. The apparatus also includes a pulley coupled with the shaft. The pulley includes a first arced portion adapted to be coupled with a first cord that is coupled with first edges of the slats and a second arced portion axially aligned with, and offset from, the first arced portion. The second arced portion is adapted to be coupled with a second cord that is coupled with second edges of the slats that are opposite the first edges. The pulley causes adjustment of the tilt angle of the slats in response to rotation of the shaft, provides a first torque at a first position corresponding to an open position of the slats, and provides a second torque at a second position corresponding to an approximately closed position of the slats, where the second torque is greater than the first torque.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures and components have not been described in detail as not to unnecessarily obscure aspects of the present invention.

Various embodiments overcome the drawbacks of conventional worm gear-based slat adjustment mechanisms in window blinds by providing an improved, variable-speed and -torque slat adjustment mechanism that provides for higher speed slat rotation when less torque is needed and higher torque when more torque is needed (e.g., to completely close the slats). Various embodiments include one or more bevel gears, which have a lower gear ratio, and thus provide faster rotation, than a conventional worm gear. Various embodiments also include a pulley with a varying radial profile, which causes slat adjustment torque to increase (and thus slat adjustment speed to decrease), at least in part, as the slats are adjusted from an open position to a closed position.

Figure 1:
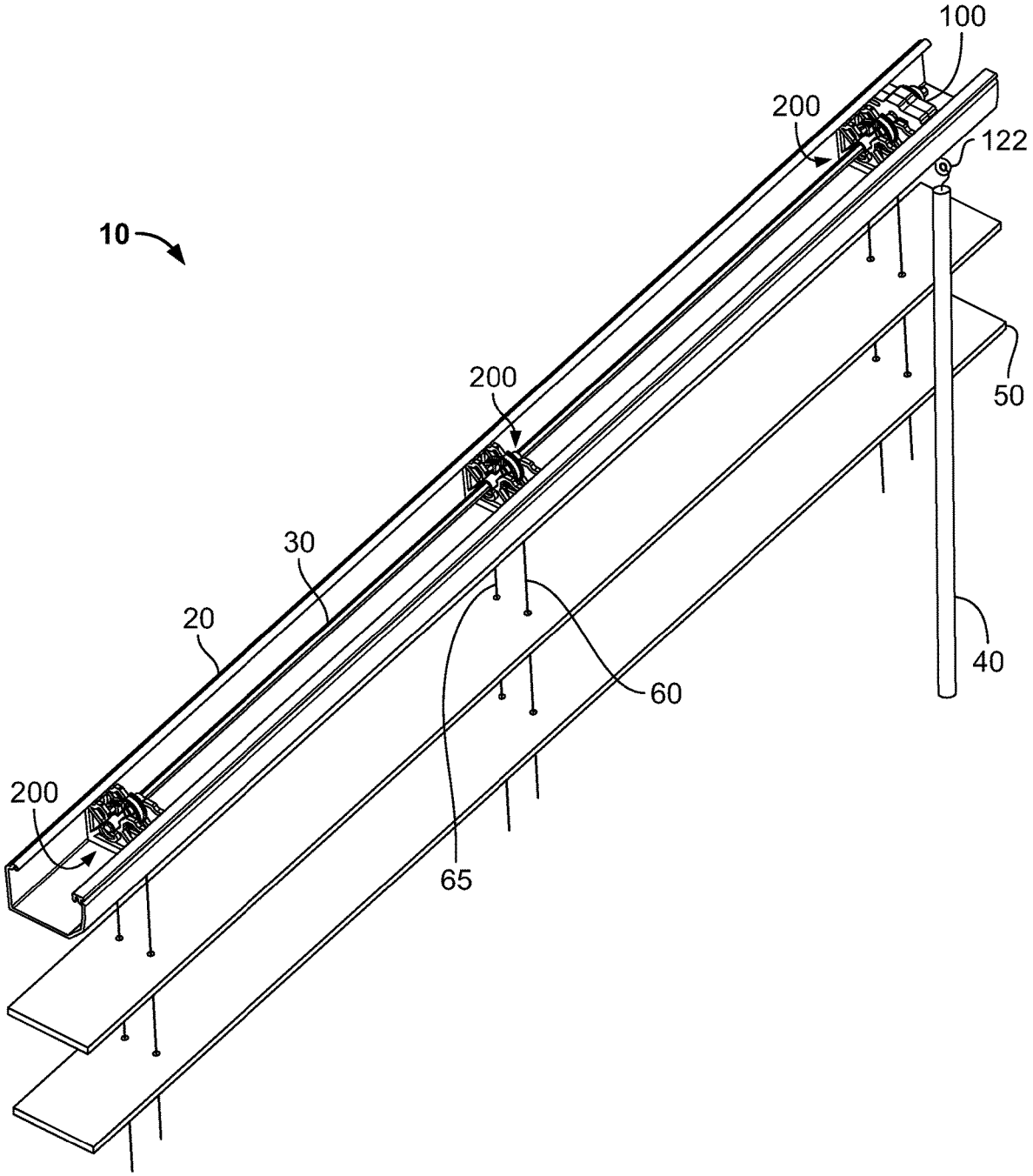
FIG. 1 illustrates a window blind, in accordance with various embodiments of the present invention.

FIG. 1 illustrates a window blind 10, in accordance with various embodiments of the present invention. The window blind 10 includes a headrail 20 and a plurality of slats 50 suspended therebeneath. The window blind 10 also includes a wand 40 that cooperates with a slat angle adjustment mechanism to adjust the angles of the slats 50. The slat angle adjustment mechanism may include, for example, a gear assembly 100, one or more pulley assemblies 200, and a shaft 30 coupling the gear assembly 100 with the pulley assemblies 200. The gear assembly 100 may include an attachment point 122, such as an eyelet, for attaching to the wand 40. The gear assembly 100 may further translate rotational motion of the wand 40 into rotational motion of the shaft 30, which in turn may cause rotational motion within the pulley mechanism 200.

Figure 2:
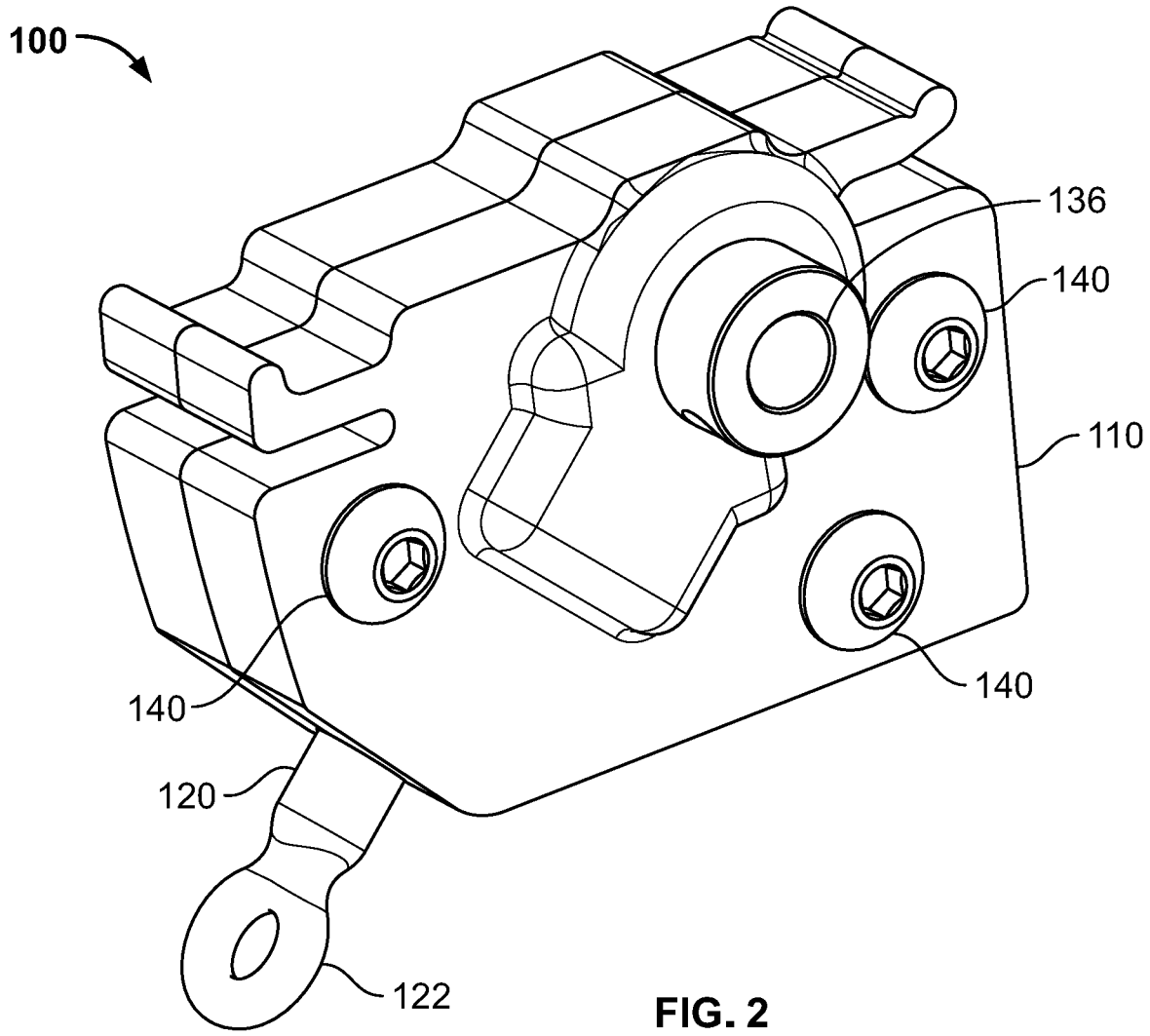
FIG. 2 illustrates a gear assembly in accordance with various embodiments of the present invention.

FIG. 2 illustrates a gear assembly 100 in accordance with various embodiments of the present invention. The gear assembly 100 includes a housing 110, which may be secured together by one or more fasteners, such as bolts 140, or alternatively, the housing 110 may snap together. The gear assembly 100 includes a rod 120 that may extend partially out of the housing 110. The rod 120 includes an attachment point 122 for a wand 40. In the illustrated embodiment, the attachment point 122 is an eyelet, but it should be appreciated that a hook, clasp or any other suitable attachment means may be used instead. The gear assembly 100 may also include an aperture 136 sized and shaped to receive the shaft 30.

Figure 3:
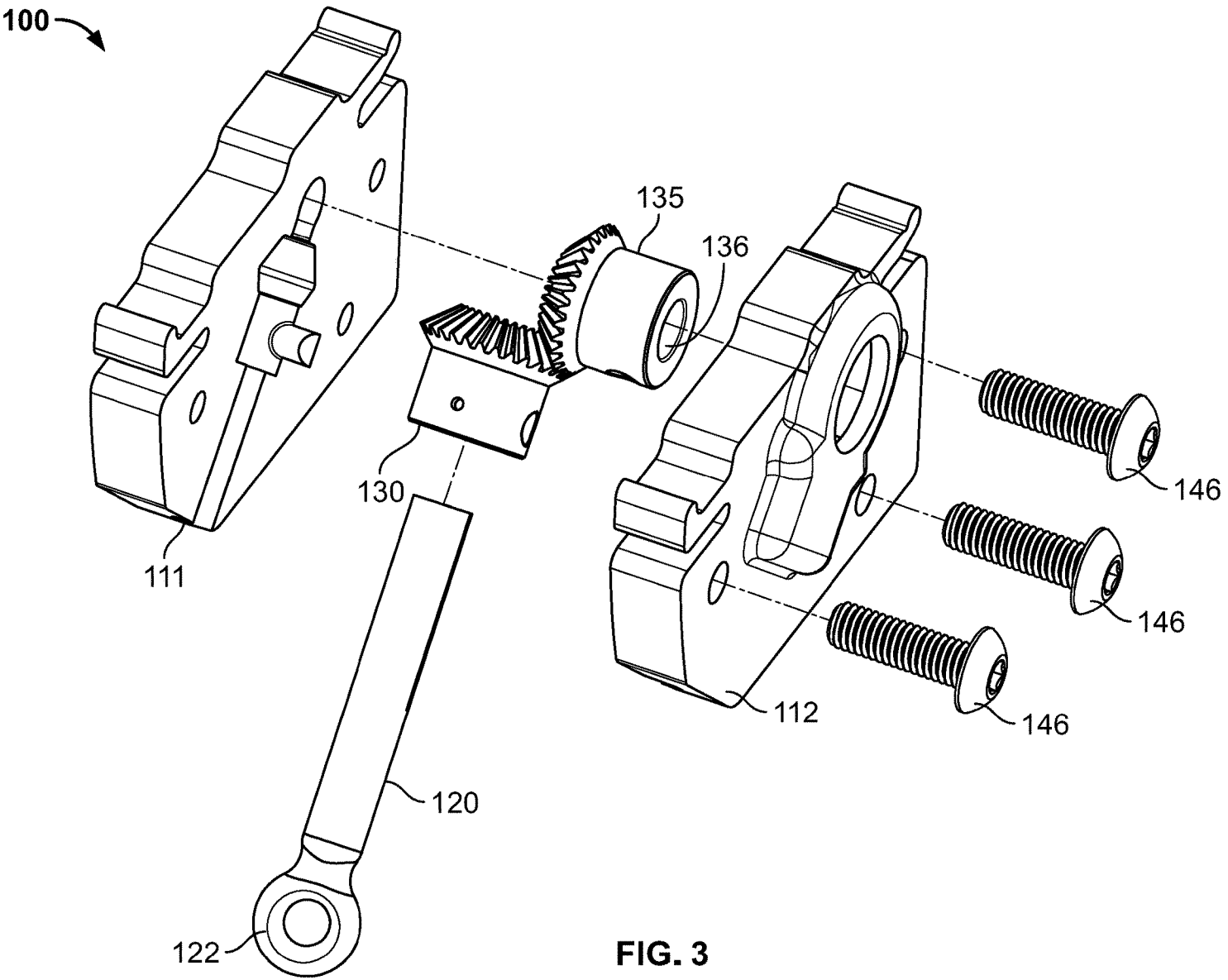
FIG. 3 is an exploded view of the gear assembly of FIG. 2, in accordance with various embodiments of the present invention.

FIG. 3 is an exploded view of the gear assembly 100 of FIG. 2, in accordance with various embodiments of the present invention. As shown, the housing 110 of the gear assembly may be a two-piece construction, comprising a first housing member 111 and a second housing member 112, which may be joined using the bolts 140. The gear assembly 100 also includes a rod 120, having two ends. One end of the rod 120 includes an attachment point 122 for a wand 40. Again, while the illustrated embodiment depicts an eyelet, any other suitable attachment means may be used for the attachment point 120 instead.

The gear assembly 100 may also include one or more bevel gears. In the illustrated embodiment, the gear assembly includes a first bevel gear 130 and a second bevel gear 135 in mechanical communication with each other. The first bevel gear 130 includes a bore (not shown) passing axially therethrough that is sized and shaped to receive the rod 120. When the rod 120 is secured into the bore of the first bevel gear 130, the first bevel gear 130 will rotate with the rod 120. The second bevel gear 135 similarly includes a bore 136 passing axially therethrough that is sized and shaped to receive the shaft 30. When the shaft 30 is secured into the bore 136 of the second bevel gear 135, the shaft 30 will rotate with the second bevel gear 135. Thus, as a result of the mechanical communication between the first bevel gear 130 and the second bevel gear 135, a rotation of the wand 40 will cause a corresponding rotation of the shaft 30. Because the gear assembly 100 utilizes bevel gears, the gear ratio of the gear assembly 100 is relatively low, which in turn leads to faster, more responsive adjustment of the slats 50. For example, a conventional window blind worm gear typically as a gear ratio of between 5:1 and 10:1, whereas some embodiments may have a gear ratio of about 1:1 or less. Thus, the slat angle adjustment mechanisms according to various embodiments are able to adjust slat angle up to 5-10 faster than conventional worm gears.

Figure 4:
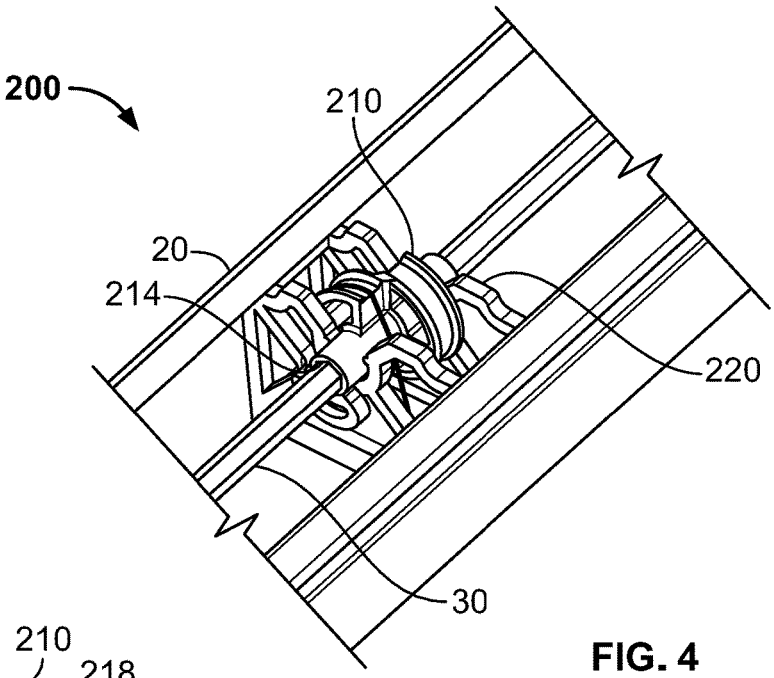
FIG. 4 illustrates a pulley assembly, in accordance with various embodiments of the present invention.

FIG. 4 illustrates a pulley assembly 200, in accordance with various embodiments of the present invention. Window blinds according to various embodiments may have one or more such pulley assemblies 200 spaced along a length of the headrail 20. As shown, the pulley assembly includes a pulley 210 and a bracket 220 for supporting the pulley 210. The pulley 210 includes an aperture 214 that is sized and shaped to receive the shaft 30. As such, the pulley 210 may rotate along with the shaft 30.

Figure 5:
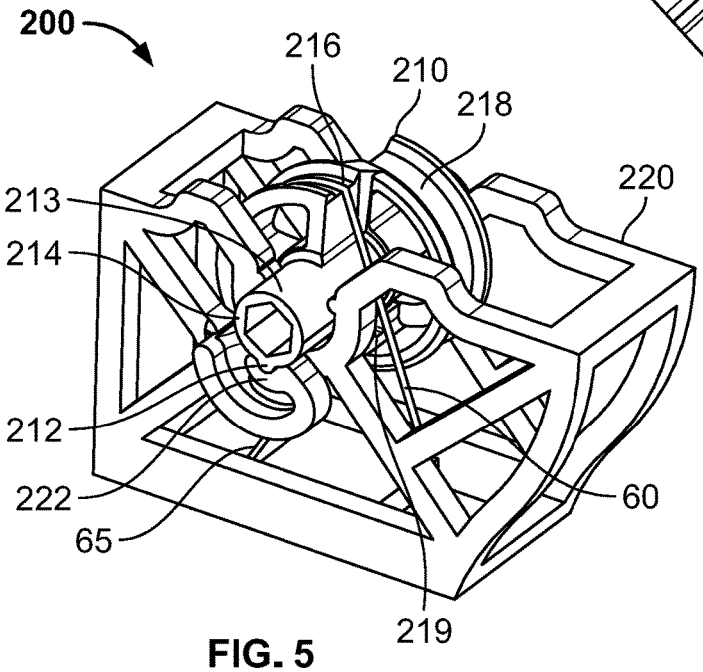
FIG. 5 is an enlarged view of a pulley assembly, in accordance with various embodiments of the present invention.

FIG. 5 is an enlarged view of a pulley assembly 200, in accordance with various embodiments of the present invention. The pulley 210 includes an axle 213 and a plurality of arced portions 216, 218. The arced portions 216, 218 guide respective cords 60, 65 and attach to the cords 60, 65 at respective attachment points 217 (shown in FIG. 6), 219. In various embodiments, the arced portions 216, 218 each have variable radial profiles (discussed in more detail with respect to FIGS. 6 and 7 below), which in turn provides variable torque depending on the rotational position of the pulley 210. In some embodiments, the pulley 210 provides lower torque (and higher speed) at a rotational position generally corresponding to the open position of the slats 50 and increased torque (and reduced speed) at rotational positions corresponding to a closed or an approaching-closed position of the slats 50.

The pulley assembly 200 also includes a resistance mechanism that resists back-drive on the pulley when the slats 50 are in the closed position. For example, in the illustrated embodiment, the bracket 220 includes a detent 222 and the pulley includes a corresponding protrusion 212 (e.g. on the axle 213). In the illustrated embodiment, the protrusion 212 is generally radially aligned with one or more linear portions of the pulley 210 that are opposite the arced portions 216, 218 thereof. Thus, when the protrusion 212 seats into the detent 222, they cooperate to resist and/or offset the back-drive caused by the weight of the slats 50 when they are in the closed position. The relative position of the protrusion 212 on the axle 213 when it is seated in the detent 222 corresponds approximately to the closed position of the slats 50.

Figure 6:
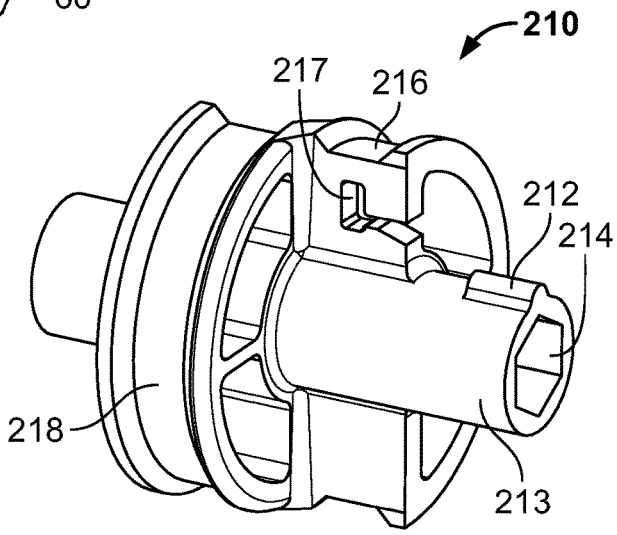
FIG. 6 is an enlarged view of a pulley, in accordance with various embodiments of the present invention.

FIG. 6 is a further enlarged view of the pulley 210, in accordance with various embodiments of the present invention. In the illustrated embodiment, the arced portions 216, 218 have variable radial profiles (e.g. relative to an axis passing through axle 213, in that arced portions 216, 218 each have a generally semi-circular shape. Thus, the radial profiles of each of the arced portions transition from larger radii to smaller radii at the nodes (e.g., corners) of the respective arcs. Although that is an abrupt transition in the example of an arced portion with a semi-circular shape, other shapes could provide for more gradual transitions. For example, arced portions 216, 218 could instead have a cam shape, a spiral shape, or the like. Additionally, in some embodiments, the arced portions 216, 218 may be axially and radially offset so as to provide independent, complementary radial profiles and torque curves for the cords, 60, 65. For example, the arced portions may be radially offset from each other by 180 degrees.

FIG. 6 also shows an example first attachment point 217 for a first cord 60, which in the illustrated embodiment is a notch into which the first cord 60 can be inserted laterally. The portion of the first cord 60 that is to lie behind the first attachment point 217 would either be knotted or otherwise have a collar that would prevent the first cord 60 from being pulled longitudinally through the first attachment point 217, and then the first cord 60 would then be draped over the first arced portion 216. Although not shown in FIG. 6 (but partially shown in FIG. 5), the second arced portion 218 includes a similar, second attachment point 219. In the illustrated example, the second attachment point 219 of the second arced portion 218 would likewise be located on the back side of the second arced portion 218 and, in the orientation of FIG. 6, just below the upper corner of the second arced portion 218.

Figure 7C:
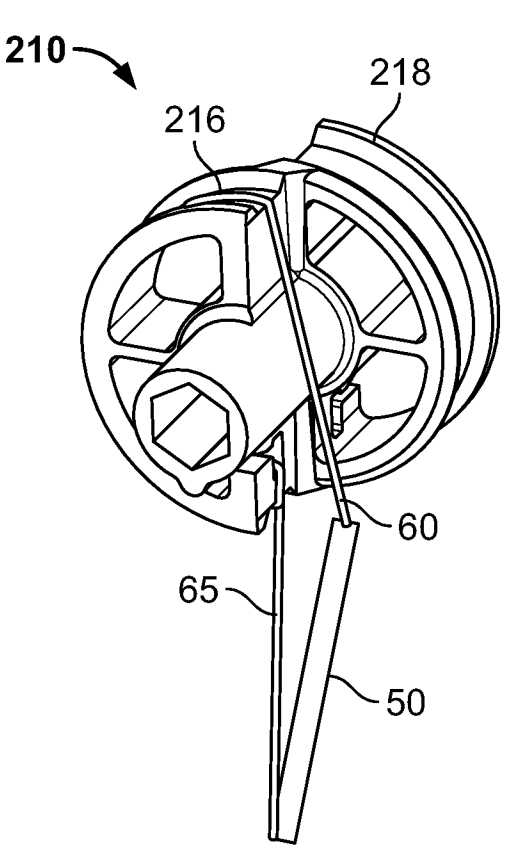
FIG. 7C shows a 180-degree counterclockwise rotation of the pulley of FIG. 7A, in accordance with various embodiments of the present invention.
Figure 7B:
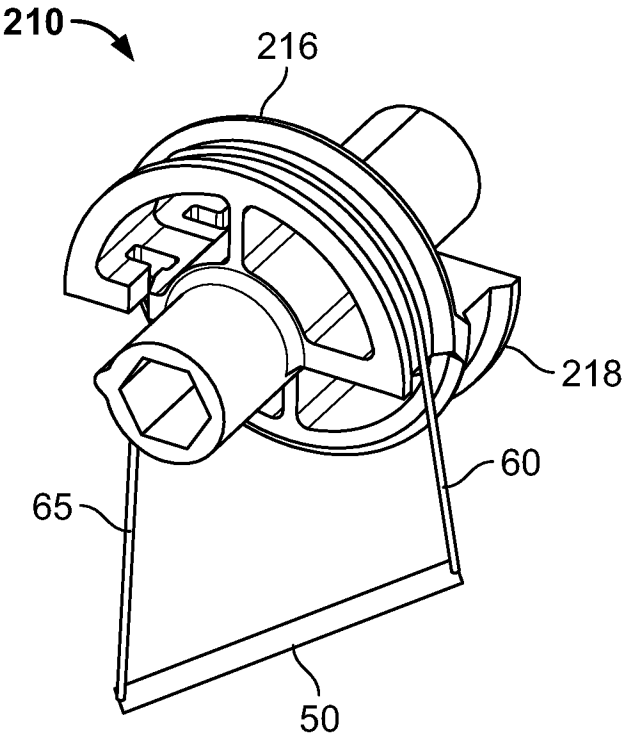
FIG. 7B shows a 90-degree counterclockwise rotation of the pulley of FIG. 7A, in accordance with various embodiments of the present invention.
Figure 7A:
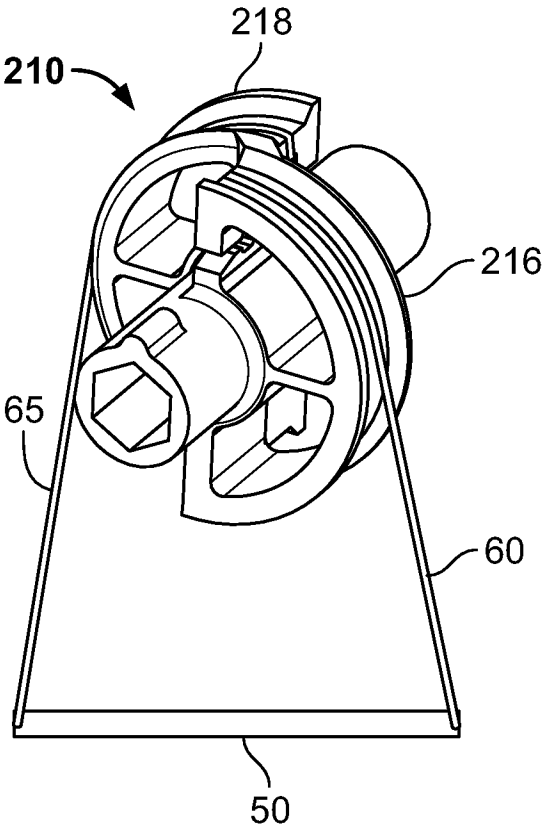
FIG. 7A shows a baseline, zero-degree position of a pulley 210, in accordance with various embodiments of the present invention.

FIGS. 7A-C show a series of images of the pulley 210 and a connected slat 50 at various stages of rotation, in accordance with various embodiments of the present invention. (It should be appreciated that for illustrative purposes, FIGS. 7A-C are not drawn to scale and only depict a single slat 50.) Specifically, FIG. 7A shows a baseline, zero-degree position of the pulley 210, which corresponds to an open (e.g. generally horizontal) position of the slat 50, FIG. 7B shows a 90-degree counterclockwise rotation of the pulley 210, which corresponds to an approximately 45-degree counterclockwise rotation of the slat 50, and FIG. 7C shows a 180-degree counterclockwise rotation of the pulley 210, which corresponds to a closed (e.g. generally vertical) position of the slat 50.

As shown in FIGS. 7A-7C, the first arced portion 216 is coupled with the first cord 60, which is in turn coupled with the front edges of the slats 50, and the second arced portion 218 is coupled with the second cord 65, which is in turn coupled with the rear edges of the slats 50. Thus, counterclockwise rotation of the pulley 210 causes the first arced portion to draw in the first cord 60 and the second arced portion to let out the second cord 65, thereby causing a counterclockwise rotation of the slat 50, and clockwise rotation of the pulley 210 causes the first arced portion 216 to let out the first cord 60 and the second arced portion 218 to draw in the second cord 65, thereby causing the slat 50 to rotate clockwise.

In the illustrated embodiment, as the pulley 210 rotates from the position of FIG. 7A to the position of FIG. 7B, the arced surfaces of the arced portions 216, 218 generally maintain the cords 60, 65 at a constant distance from the axis of the pulley 210, thereby maintaining relatively constant speed and torque. However, starting at the position of FIG. 7B, and continuing to the position of FIG. 7C, the distance between the cord 60 and the axis of the pulley 210 gradually decreases, thereby causing a gradual increase in torque and decrease in speed. Thus, in the process of closing the slat, the angle adjustment mechanism of the illustrated embodiment provides relatively high speed and low torque when the slat 50 is between the open position and approximately 45 degrees of rotation therefrom, and relatively lower speed and higher torque when the slat 50 is between approximately the 45 degree and closed positions of the slat 50. More specifically, the torque of the slat angle adjustment mechanism increases so that a maximum torque is provided as the slats 50 approach the closed position.

Thus, various embodiments provide for a window blind slat angle adjustment mechanism that is generally high speed, but also decreases speed and provides increased torque when needed to completely close the blinds. The mechanism also resists back-drive, so as to keep the blinds closed. Such embodiments provide a significant improvement in speed and ease of use over conventional worm gear-based mechanisms, which can be up to 5-10 times slower and therefore require significantly more turns of the adjustment wand to open or close the blinds.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An apparatus for adjusting a tilt angle of a plurality of slats in a window blind, the window blind including a headrail having disposed therein a shaft that rotates responsive to rotation of an externally accessible angle adjustment wand, the apparatus comprising:

a pulley coupled with the shaft and the slats, wherein the pulley causes adjustment of the tilt angle of the slats in response to rotation of the shaft, wherein the pulley provides a first torque when turned from a first position corresponding to an open position of the slats, wherein the pulley provides a second torque when turned from a second position corresponding to an approximately closed position of the slats, and wherein the second torque is greater than the first torque;

wherein the pulley comprises a first semicircular arced portion that is adapted to be coupled with a first cord that is coupled with first edges of the slats, and a second semicircular arced portion that is adapted to be coupled with a second cord that is coupled with second edges of the slats, wherein the second edges are opposite the first edges.

2. The apparatus of claim 1, wherein rotation of the pulley in a first direction causes the first arced portion to pull in the first cord and the second arced portion to let out the second cord, and wherein rotation of the pulley in a second direction opposite the first direction causes the first arced portion to let out the first cord and the second arced portion to pull in the second cord.

3. The apparatus of claim 1, wherein the first cord is a first distance from an axis of the pulley when the pulley is in the first position and a second distance from the axis of the pulley when the pulley is in the second position, the second distance being shorter than the first distance.

4. The apparatus of claim 1, wherein:

the first arced portion comprises:

a first end;

a second end; and an attachment point for the first cord proximate the first end, and the second position corresponds to the second end of the first arced portion being oriented distal to the slats.

5. The apparatus of claim 1, wherein the pulley comprises a bore passing axially therethrough that is sized and shaped to receive the shaft, wherein the pulley rotates with the shaft.

6. The apparatus of claim 1 further comprising a bracket that supports the pulley within the headrail and permits the pulley to rotate.

7. The apparatus of claim 6, wherein one of the bracket and the pulley comprises a detent and the other of the bracket and the pulley comprises a protrusion that mates with the detent to resist rotation of the pulley when the pulley is in the second position.

8. The apparatus of claim 7, wherein the bracket comprises the detent and the pulley comprises the protrusion.

9. The apparatus of claim 1, wherein between the first position and a third position that is rotationally between the first and second positions, the pulley provides the first torque.

10. The apparatus of claim 1, wherein between the second position and a third position that is rotationally between the first and second positions, the pulley provides a torque that gradually increases from the first torque at the third position to the second torque at the second position.

11. The apparatus of claim 10, wherein the torque nonlinearly increases from the first torque to the second torque.

12. An apparatus for adjusting a tilt angle of a plurality of slats in a window blind, the window blind including a headrail having disposed therein a shaft, the apparatus comprising:

a gear assembly comprising:

a rod having a first end and a second end, the first end adapted to couple with a wand;

a first bevel gear coupled with the rod; and a second bevel gear in mechanical communication with the first bevel gear and coupled with the shaft, wherein a rotation of the wand causes a corresponding rotation of the shaft; and a pulley coupled with the shaft, the pulley comprising:

a first semicircular arced portion adapted to be coupled with a first cord that is coupled with first edges of the slats; and a second semicircular arced portion adapted to be coupled with a second cord that is coupled with second edges of the slats that are opposite the first edges;

wherein the pulley causes adjustment of the tilt angle of the slats in response to rotation of the shaft, wherein the pulley provides a first torque when turned from a first position corresponding to an open position of the slats, wherein the pulley provides a second torque when turned from a second position corresponding to an approximately closed position of the slats, and wherein the second torque is greater than the first torque.

* * * * *